United States Patent [19]

Popper, Jr.

[11] 4,300,744

[45] Nov. 17, 1981

[54] APPARATUS FOR ENABLING MOVEMENT OF A BINDER BETWEEN STORED AND READABLE POSITIONS RELATIVE TO A SUPPORT

[76] Inventor: Robert H. Popper, Jr., 24 Raynold Rd., Mountain Lakes, N.J. 07046

[21] Appl. No.: 960,726

[22] Filed: Nov. 14, 1978

[51] Int. Cl.[3] ..... A47B 97/04

[52] U.S. Cl. ..... 248/447

[58] Field of Search ..... 248/317, 359, 447; 312/233; 281/45

[56] References Cited

U.S. PATENT DOCUMENTS

| | | | |
|---|---|---|---|
| 562,988 | 6/1896 | van Meter | 248/447 |
| 1,318,567 | 10/1919 | Key | 248/359 |
| 1,888,748 | 11/1932 | Thornton | 248/447 |
| 2,059,679 | 11/1936 | Burton | 248/447 |
| 3,275,279 | 9/1966 | Caldwell | 312/233 X |
| 3,918,672 | 11/1975 | Torn | 248/447 |

*Primary Examiner*—William H. Schultz

*Attorney, Agent, or Firm*—Howard N. Sommers

[57] ABSTRACT

An apparatus for enabling movement of a binder between stored and readable positions relative to a support, including a first link, securable to the support, contoured in shape, and a second link, securable to the binder, interconnectable with the first link, contoured in shape, slidably movable along a portion of the contour of the first link which extends in two planes, such that the binder is movable therealong between stored and readable positions, to enable access to and reading of the book enclosed in the binder, such as telephone directories, and storage thereof relative to the support, such as a shelf in a telephone enclosure, in a convenient and efficient manner.

4 Claims, 8 Drawing Figures

APPARATUS FOR ENABLING MOVEMENT OF A BINDER BETWEEN STORED AND READABLE POSITIONS RELATIVE TO A SUPPORT

BACKGROUND OF THE INVENTION

The invention relates generally to apparatuses for connecting an article to a surface, and specifically to an apparatus for enabling movement of a binder between stored and readable positions relative to a support.

Presently, apparatuses for connecting a binder, as a binder for books such as telephone directories, to a support, such as a shelf in a telephone enclosure, are inefficient and inconvenient to utilize.

SUMMARY OF THE INVENTION

In view of the above, one of the objects of the invention is to provide an apparatus for enabling movement of a binder between stored and readable positions relative to a support, which is convenient and efficient to utilize.

The above object, as well as others, are provided for in the invention by means of an apparatus for enabling movement of a binder between stored and readable positions relative to a support, including a first link, securable to the support, contoured in shape, and a second link, securable to the binder, interconnectable with the first link, contoured in shape, slidably movable along a portion of the contour of the first link which extends in two planes, such that the binder is movable therealong between stored and readable positions, to enable access to and reading of the book enclosed in the binder, such as telephone directories, and storage thereof relative to the support, such as a shelf in a telephone enclosure, in a convenient and efficient manner.

DESCRIPTION OF THE DRAWINGS

The invention is illustrated, by way of example thereof, in the accompanying drawings, wherein.

DESCRIPTION OF THE PREFERRED EMBODIMENT

The preferred embodiment of the invention, as illustrated in the Figures, comprises, for example, an apparatus for enabling movement of a binder, such as a binder 10 for books such as telephone directories, between stored and readable positions relative to a support, such as shelf 11 in a telephone enclosure, which apparatus comprises a first link 12, securable to the shelf 11, contoured in shape, and a second link 13, securable to the binder 10, interconnectable with the first link 12, contoured in shape, and slidably movable along a portion of the contour of the first link 12 which extends in two planes, such that the binder 10 is movable therealong between stored and readable positions.

Figure 1:
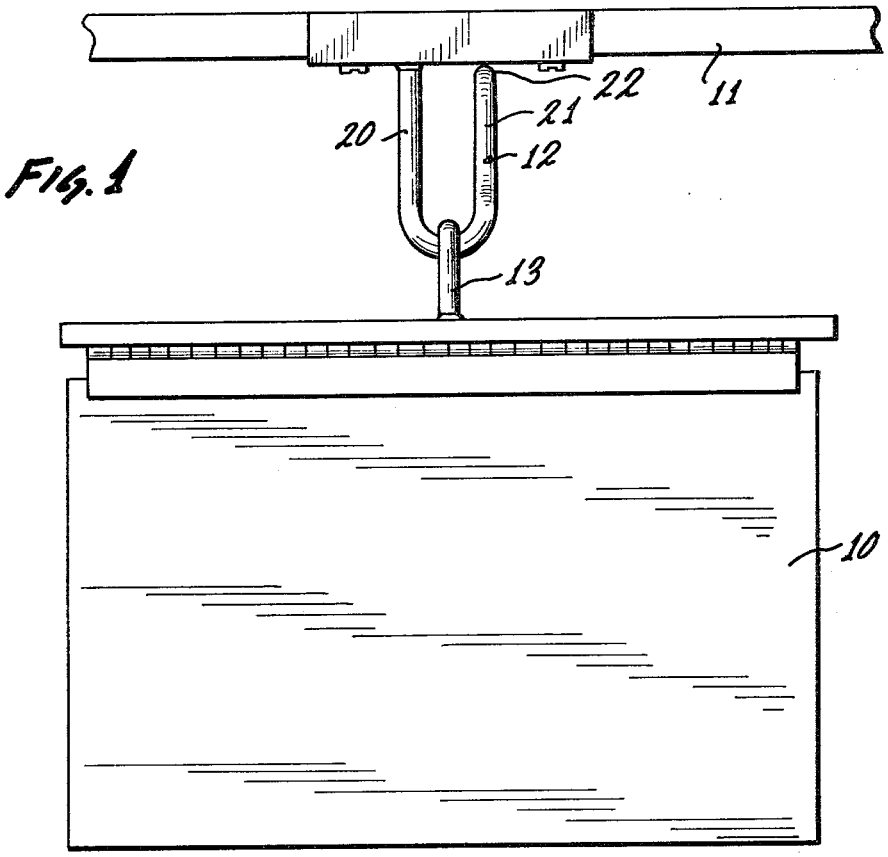
FIG. 1 is a front elevational view of one embodiment of the binder movement-enabling apparatus, with the binder in stored position.
Figure 2:
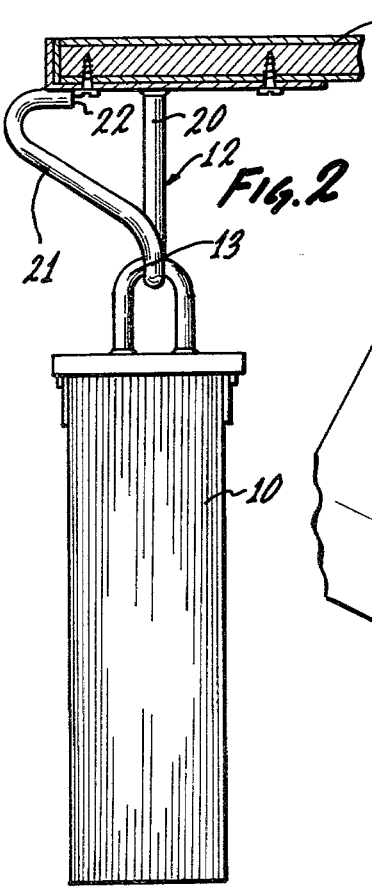
FIG. 2 is an end elevational view thereof.
Figure 3:
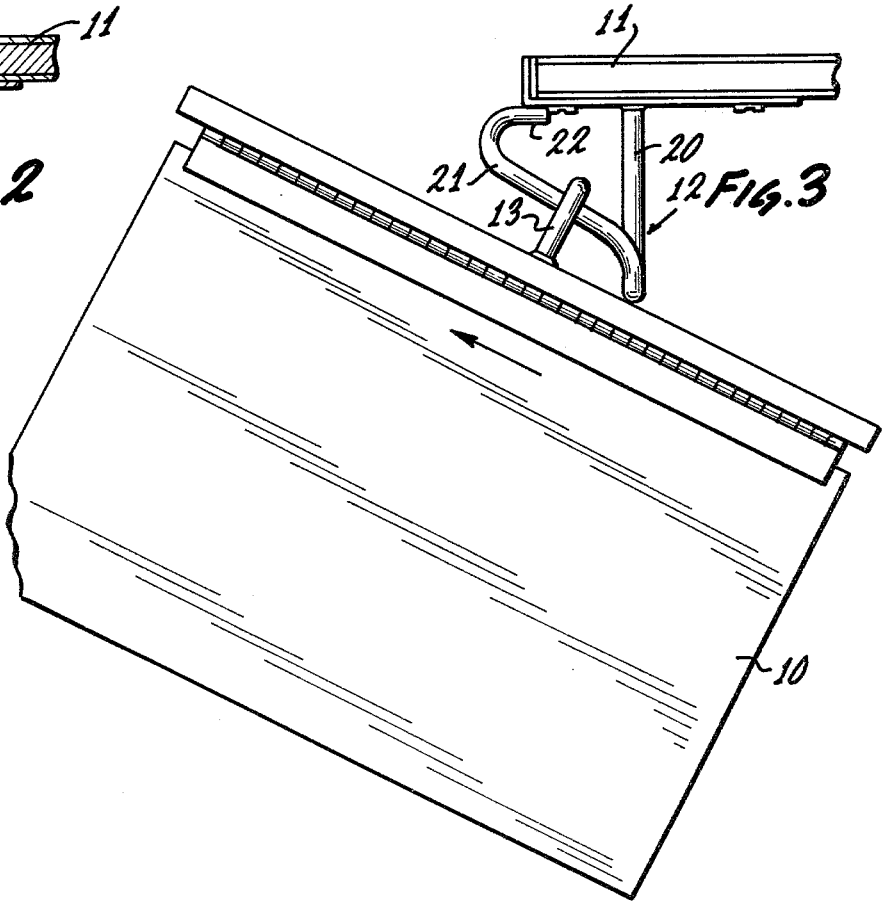
FIG. 3 is an end elevational view thereof with the binder in a position intermediate the supported position and the stored position.
Figure 4:
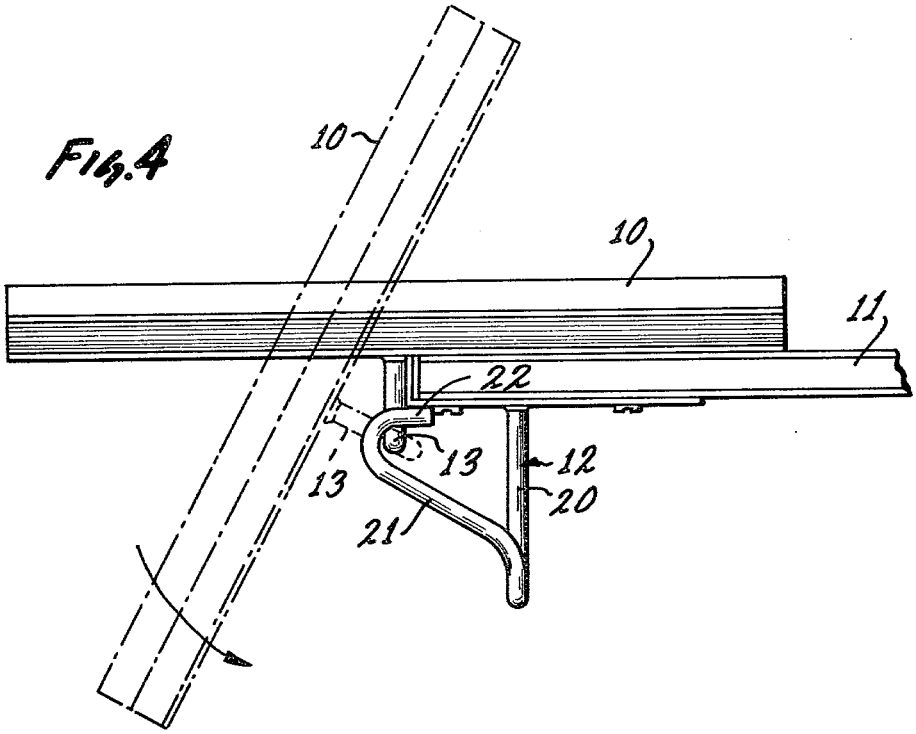
FIG. 4 is a front elevational view thereof with the binder in supported position.
Figure 5:
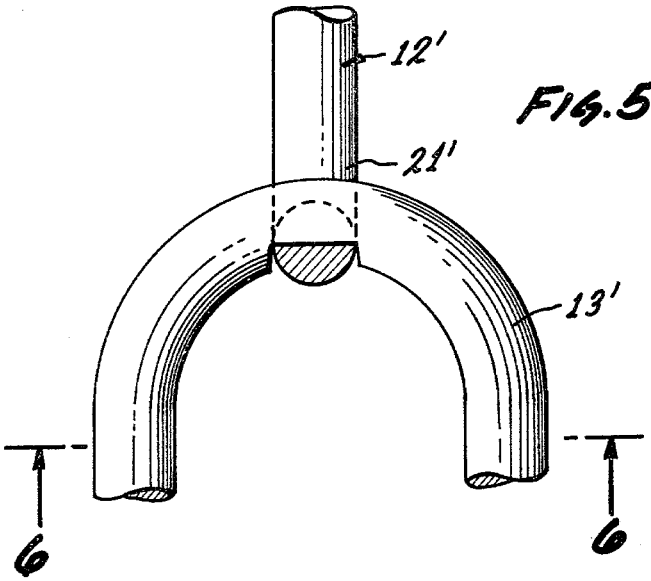
FIG. 5 is a fragmentary partly-sectional view thereof taken along line 5—5 of FIG. 1.
Figure 6:
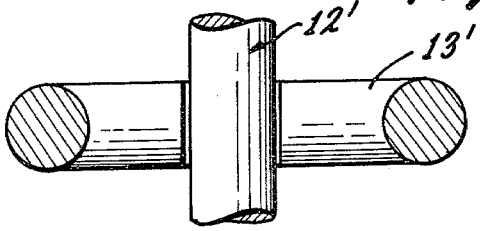
FIG. 6 is a fragmentary partly-sectional view thereof taken along line 6—6 of FIG. 5.
Figure 7:
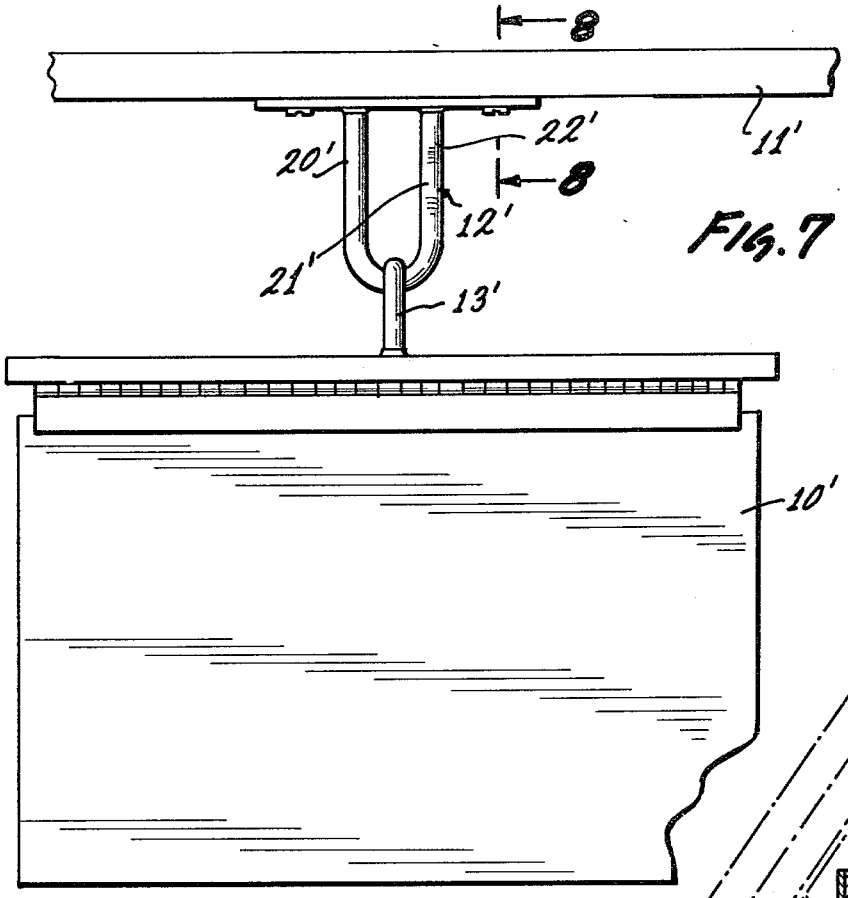
FIG. 7 is a front elevational view of another embodiment of the binder movement-enabling apparatus, with the binder in stored position.
Figure 8:
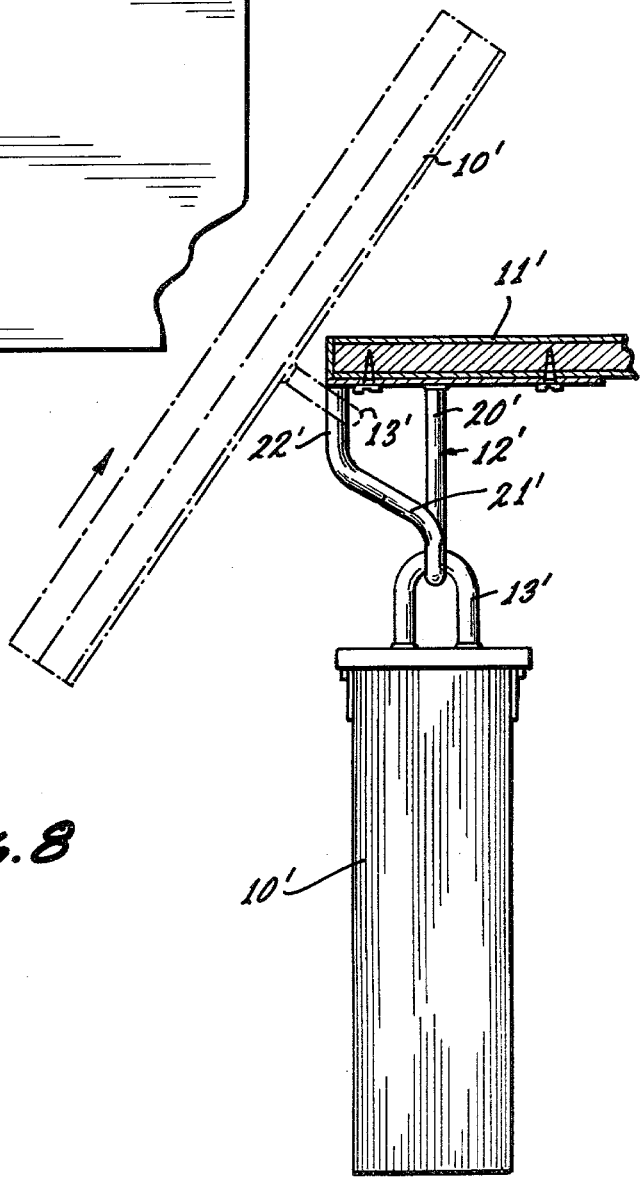
FIG. 8 is an end elevational view thereof.

The first link 12 forms a closed loop with the shelf 11, and the contour of the first link 12, in one of the preferred embodiments illustrated in FIGS. 1–4, includes a substantially J-shaped first end portion 20, a substantially straight intermediate portion 21 curved at the ends thereof, one end securable to the bottom of the shelf 11, extending at an angle from, and in a plane substantially perpendicular to, the plane of the J-shaped first end portion 20, and a substantially straight second end portion 22, extending from, and in the plane of, the intermediate portion 21, securable to the bottom portion of the shelf 11, generally perpendicular to the first end portion 20. In another one of the preferred embodiments illustrated in FIGS. 5–8, the second end portion 22' of the first link 12' extends generally parallel to the first end portion 20'.

The second link 13 forms a closed loop with the binder 10, the contour thereof is substantially U-shaped, and the opposite ends thereof are securable to the central portion of the back of the binder 10, to provide controlled suspension of the binder 10 for stability.

The user may move the binder 10, and the telephone directories enclosed therein, from stored to readable position relative to the shelf 11, by moving the binder 10 through a path generally corresponding to the path of movement of the second link 13, secured to the back of binder 10, relative to the first link 12, secured to the bottom of shelf 11, which contour and path includes the plane of the bottom end portions of the substantially J-shaped first end portion 20, the substantially straight intermediate portion 21, at an angle from, and in a plane substantially perpendicular to, the plane of the J-shaped first end portion 20, and the substantially straight second end portion 22, in the plane of the intermediate portion 21 and generally perpendicular to the first end portion, to enable access to and reading of the books enclosed in the binder 10 in a convenient and efficient manner. In the embodiment illustrated in FIGS. 5–8, the final portion of the contour and path of movement of the binder 10, and telephone directories enclosed therein, from stored to readable position relative to the shelf 11, is along the substantially straight second end portion 22', in the plane of the intermediate portion 21' and generally parallel to the first end portion 21'.

The user may return the binder 10, and the telephone directories enclosed therein, from readable to stored position relative to the shelf 11, by releasing the binder 10, which moves through a path generally corresponding to the path of movement of the second link 13, secured to the back of binder 10, relative to the first link 12, secured to the bottom of shelf 11, which contour and path includes the plane of the substantially straight second end portion 22, the substantially straight intermediate portion 21, and the bottom and end portions of the substantially J-shaped first end portion, which extends in a plane generally perpendicular to the plane of the second end portion 22 and intermediate portion 21, to enable storage of the books enclosed in the binder 10 in a convenient and efficient manner. In the embodiment illustrated in FIGS. 5–8, the initial portion of the contour and path of movement of the binder 10, and telephone directories enclosed therein, from readable to stored position relative to the shelf 11, is along the substantially straight second end portion 22', in the plane of the intermediate portion 21' and generally parallel to the first end portion 21'.

The preferred embodiment of the invention has been set forth herein. However, it is to be understood that variations may be made in such preferred embodiment, which variations nevertheless may be within the scope and spirit of the invention. The invention is therefore to be broadly construed, within the scope and spirit of the claims.

I claim:

1. An apparatus adapted to interconnect a binder to a support to enable movement of the binder between stored and readable positions relative to the support, comprising:

(a) a first link, securable to the support, contoured in shape, which forms a closed link with the support, the contour of which includes a substantially J-shaped first end portion, a substantially straight intermediate portion curved at the ends thereof, extending at an angle from, and in a plane substantially perpendicular to, the plane of the J-shaped first end portion, and a substantially straight second end portion extending from, and in the plane of, the intermediate portion, generally perpendicular to the first end portion; and (b) a second link, rigidly securable to the binder, interconnectable with the first link, contoured in shape, slidably movable along a portion of the contour of the first link such that the binder is movable in a limited constrained path therealong between stored and readable positions, which forms a closed loop with the binder.

2. An apparatus adapted to interconnect a binder to a support to enable movement of the binder between stored and readable positions relative to the support, comprising:

(a) a first link, securable to the support, contoured in shape, which forms a closed link with the support, the contour of which includes a substantially J-shaped first end portion, a substantially straight intermediate portion curved at the ends thereof, extending at an angle from, and in a plane substantially perpendicular to, the plane of the J-shaped first end portion, and a substantially straight second end portion extending from, and in the plane of, the intermediate portion, generally parallel to the first end portion; and (b) a second link, rigidly securable to the binder, interconnectable to the first link, contoured in shape, slidably movable along a portion of the contour of the first link such that the binder is movable in a limited constrained path therealong between stored and readable positions, which forms a closed loop with the binder.

3. An apparatus as in claim 1, in which the opposite end portions of the first link are securable to the bottom portion of the supporting surface.

4. An apparatus as in claim 1, in which the opposite ends of the second link are securable to the central portion of the back of the binder.

* * * * *